United States Patent [19]

Lipe et al.

[11] 4,247,250

[45] Jan. 27, 1981

[54] FABRICATED PUMP CASING

[75] Inventors: Bruce R. Lipe; Robert J. Meyer, both of Cincinnati, Ohio

[73] Assignee: Allis-Chalmers Corporation, Milwaukee, Wis.

[21] Appl. No.: 72,465

[22] Filed: Sep. 4, 1979

[51] Int. Cl.³ ..... F04D 29/40

[52] U.S. Cl. ..... 415/219 C; 415/97; 415/201; 415/204

[58] Field of Search ..... 415/97, 98, 102, 204, 415/206, 219 C, 201

[56] References Cited

U.S. PATENT DOCUMENTS

| | | | |
|---|---|---|---|
| 632,572 | 9/1899 | Ivens | 415/97 |
| 1,197,653 | 9/1916 | Norton | 415/204 X |
| 1,462,890 | 7/1923 | Taylor | 415/219 C |
| 2,611,578 | 9/1952 | Biggs | 415/219 C |
| 2,994,348 | 8/1961 | Cape | 415/219 C |

FOREIGN PATENT DOCUMENTS

| | | | |
|---|---|---|---|
| 313025 | 3/1956 | Switzerland | 415/219 C |
| 254464 | 7/1926 | United Kingdom | 415/219 C |

*Primary Examiner*—Leonard E. Smith
*Attorney, Agent, or Firm*—Robert C. Jones

[57] ABSTRACT

A fabricated split pump casing is disclosed in which the suction chamber and discharge chamber are both on the same side of the casing section. The volute is fabricated from a plurality of sections with the minor section of the volute being located within the suction chamber thereby providing maximum suction chamber area.

5 Claims, 8 Drawing Figures

FABRICATED PUMP CASING

BACKGROUND OF THE INVENTION

This invention relates to centrifugal pump and more specifically to the fabrication of a double suction casing for pumps. In the manufacturing of pumps of the type herein being considered, the normal procedure is to manufacture the various components as castings which involve the providing of patterns that are costly to manufacture and which have been found to wear so as to impair the efficiency of the pump itself. In the pump art, it is not unreasonable to find that repairs to pumps manufactured thirty or more years ago is often requested. However, often times the patterns for these pumps from which the various castings are made are no longer available, and, thus, the demands of the customers cannot be met resulting in scrapping of a particular type of pump, especially a pump that is specifically designed for a specific job application. Thus, customers are required to purchase entirely new pumps of present design which may or may not fit the piping arrangement which exists for the pumps that were applied thereto for 30 years. As a result, the customer must revamp the piping lines materially adding the cost of securing a new pump. It is also noted that in the past the pumps which were cast were restricted application, in that some materials such as stainless steel could not be supplied to a customer in the cast pump format. This means that the pump of normal cast iron would be utilized but it would not function or operate for a time interval satisfactory to most installation conditions where stainless steel was needed.

It is also know that the suction passage of a double-suction casing is a critical design area. The water must turn several times to reach the impeller inlet and cavitation, noise, separation and vibration can result if the suction area is not sufficiently large enough.

It is an object of the present invention to provide a fabrication technique for double-suction casings of a centrifugal pump.

Another object of the invention is to provide a fabricated volute section for a split case centrifugal pump.

Still another object of the present invention is to fabricate the volute section of a centrifugal pump from a plurality of fabricated volute sections from a plurality of computer designed volute sections which provide an optimum pump case with smooth transitional joints.

A still further object of the present invention is to provide a fabricated pump casing with the discharge and suction passage on the same side of the casing.

A further object of the present invention is to provide a fabricated centrifugal pump in which casing is provided with a parting line and utilizes standard rotating elements.

SUMMARY OF THE INVENTION

In the fabrication of the centrifugal pump herein disclosed the discharge and suction passage positions have been repositioned from the traditional opposite positions. In effect, the volute has been rotated 180° from its normal position in the suction passage. Also the parting line has been changed from a horizontal to a vertical position. With this arrangement, the suction and discharge piping connections end up on the same half of the casing. In rotating the volute 180° from its traditional position, the small size volute sections pass through the suction passage instead of the larger size volute sections. This immediately provides an increase in suction passage area, although the conventional design retaining the suction and discharge on opposite sides can be retained. In the fabrication proposed herein, the volute is designed and flame-cut section made FIGS. 4*a* and 4*b*. The volute cross-sectional shapes which, as shown in FIG. 2, are arcs, provide a favorable flow pattern in the suction passage wherein the volute passes through. The volute sections are eighteen in number and are laid out in 20° increments to accommodate the parting line of the casing. However, other suggested economical ranges of volute sections are in the range of 16 section of 22½° angle to 24 sections of 15° angle.

DESCRIPTION OF THE DRAWINGS

FIGS. 4A and 4B taken together is a developed view of the volute sections;

DESCRIPTION OF THE INVENTION

Figure 2:
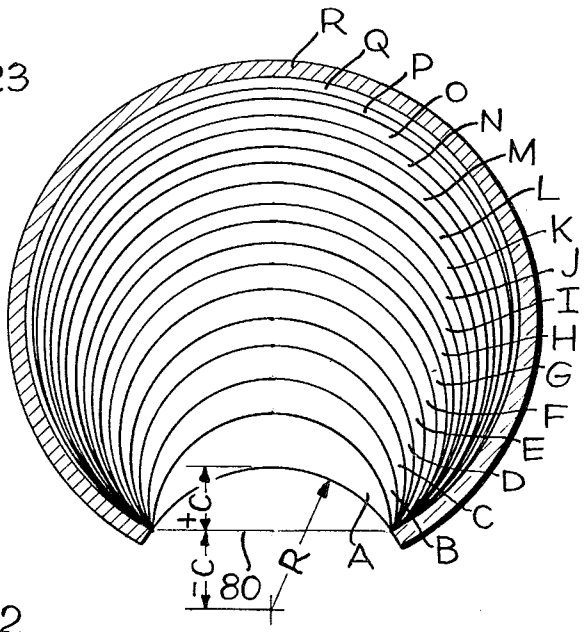
FIG. 2 is a volute section detail.

Referring now to the drawings, a pump 20 constructed in accordance with the present invention has a fabricated casing 21 providing a suction inlet 22 and discharge outlet 23 arranged on the same side of the casing. The casing is of the split type and includes a right-hand portion 26, as viewed in FIGS. 1 and 6, constituting the suction and discharge inlets and the minor, or smaller, volute section 25. The casing also includes the left-hand portion 27 as viewed in FIGS. 1 and 6, which includes the major, or larger, volute section 28 of the volute 29, arranged to communicate with the pump impeller chamber 30 shown in FIG. 3.

The entire pump assembly is supported by a means of a base 41 which is fabricated of steel sheet plate having upwardly extending support members that are welded to side plates 42 and 43.

The pump casing is a fabricated structure formed of sheet steel that provides special advantages for low volume pump casings at reduced costs by eliminating the necessity of patterns for the pump body casing as in the usual manner. An additional advantage in the fabricated pump casing is that, in cases where special alloy steels are required, they can be easily incorporated into the structure disclosed herein without any additional tooling or special procedures. It also eliminates the necessity of providing a new casting design which may be required if the shrinkage was different from previous materials cast. The fabricated structure also provides greater flexibility in design in that suction and discharge, inlet and outlet, can be moved to suit customers requirement which cannot be readily done with a cast design in that a pattern change would have to be effected which is very expensive. In the fabricated process, shorter manufacturing lead time results since the fabrication of the casing can be started immediately after the drawings are completed. With a cast design, the lead time is long since the patterns must be made, the castings pored, all of which involves a relatively long lead times. Another, not in material, advantage of the fabricated casing is that it is less weight than a comparible cast structure, since the wall thicknessess can be less in fabrication. Sheet steel has very uniform strength and its thickness is also uniform. Cast iron or cast steel often varies in wall thickness due to core shift.

Figure 1:
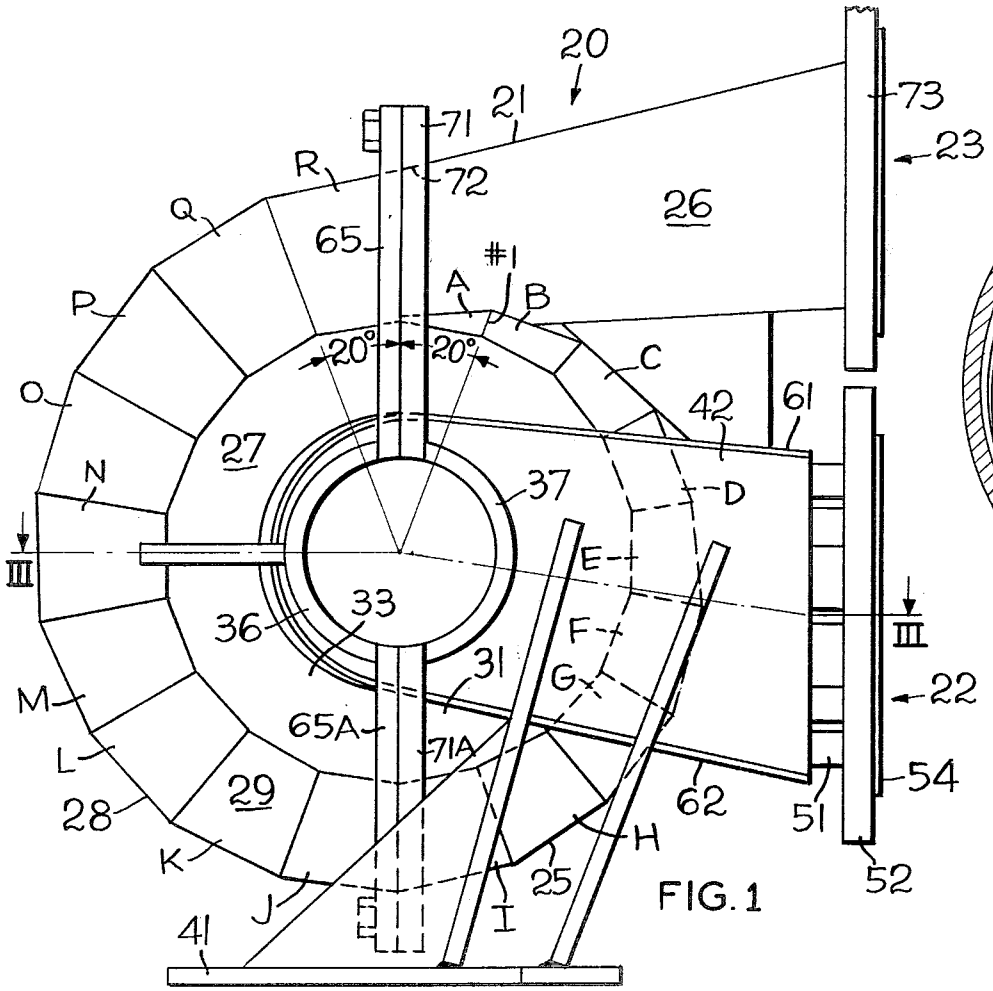
FIG. 1 is a view in left-side elevation of the fabricated casing for a double suction centrifugal pump.
Figure 3:
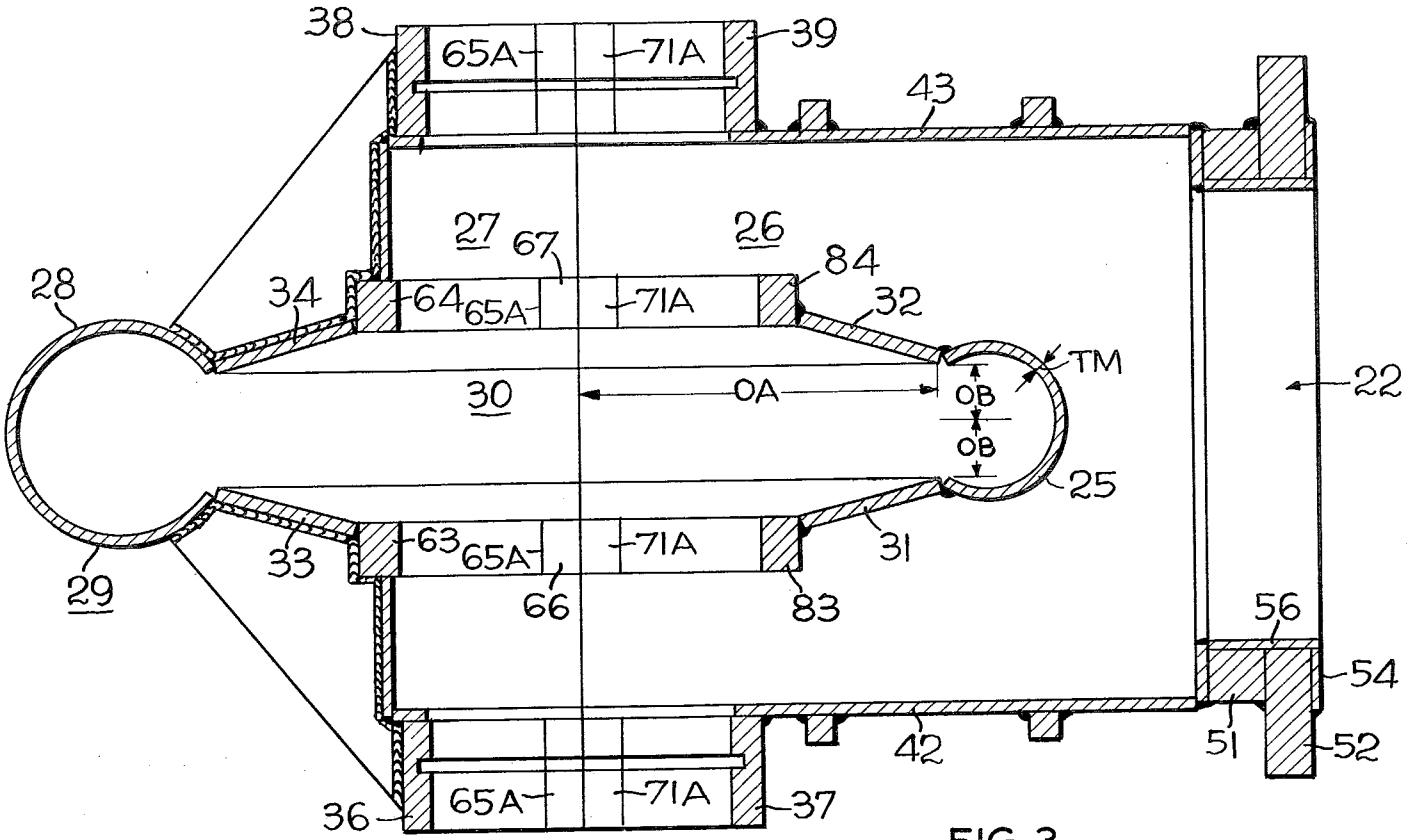
FIG. 3 is a horizontal section view through the casing of FIG. 1 taken in a plane represented by the line III—III in FIG. 1.
Figure 4A:
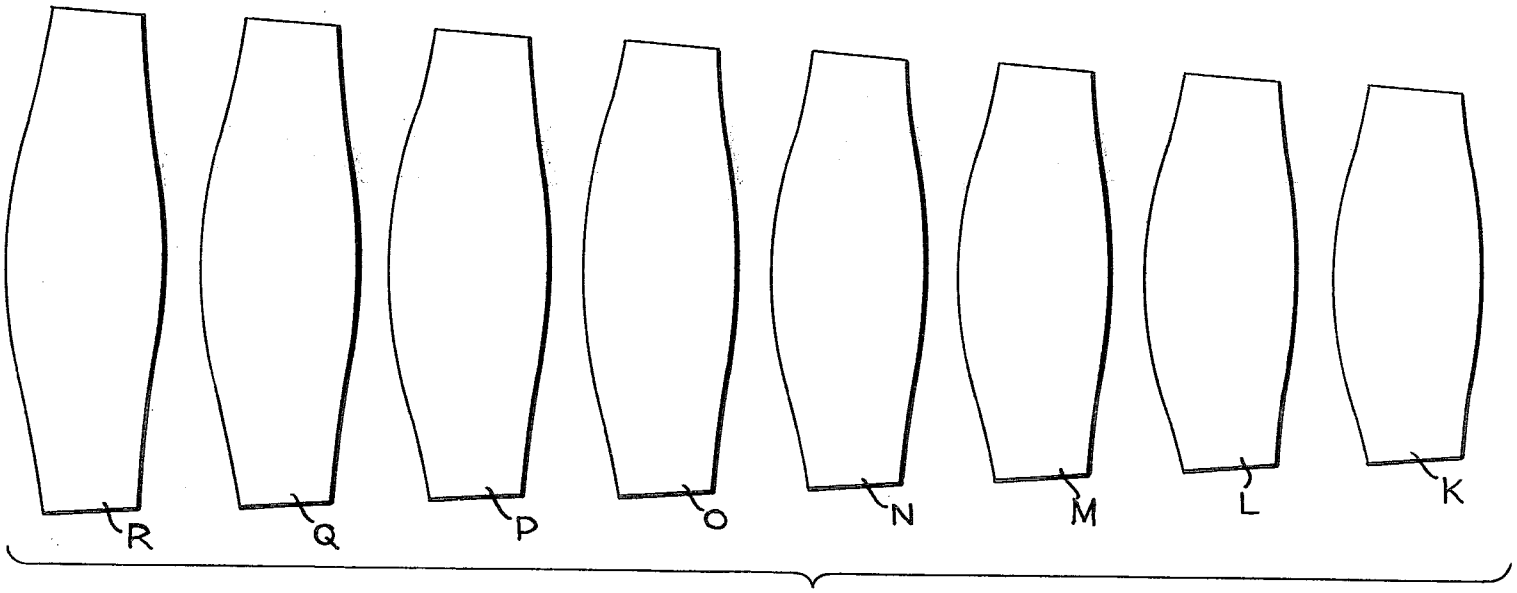

As shown in FIGS. 1 and 3, the suction inlet 22 is constructed as a rectangular piece which includes the suction passage spacer 51 welded to a circular inlet flange plate 52 which is machined to provide an interface plate 54 that is adapted to mate with the customers piping flange. The suction chamber or passage entrance 22 section is lined with a suction passage tube 56 which provides smooth entry for the fluid into the suction chamber defined by the walls 42, 43, 61 and 62. Welded to the side plate 42 is the shaft support and stuffing box ring comprising the semi-circular portions 36 and 37. The bearing support and stuffing box associated with the side 43 is also split and, thus, is in the form of the two semi-circular pieces 38 and 39, each of which is welded to the side member 43.

Internally within the suction chamber 30, there is the impeller chamber or pumping chamber 30. The impeller or pumping chamber 30 encompasses the volute 29 fabricated of volute sections A through R and divided into the major and minor volute sections. The volute sections J and R of the major volute section 28 are welded to the outer edge of the volute half cones members 33 and 34. The inner edges of the volute half cones are, in turn, welded to the spaced apart semi-circular volute rings 63 and 64. Each of the semi-circular volute rings are, in turn, welded to upper and lower flange members 65 and 65A, one of which is shown in detail in FIG. 7. The ends of the volute rings 63 and 64 are welded to internal projections 66 and 67 formed on the flange pieces. As previously mentioned, the ends of the half cone 33 and 34 are welded to a tapered relief portion 68 of the flange pieces.

The free or outer ends of the half volute cone sections 31 and 32 associated with the right-hand casing section 26 are welded to the fabricated minor volute section 25, as viewed in FIGS. 1 and 3. The inner edges of the spaced apart of the volute half cones 31 and 32 are, in turn, welded to spaced apart semi-circular volute rings 83 and 84. Each of the semi-circular volute rings 83 and 84 are, in turn, welded to upper and lower flange members 71 and 71A.

The upper portion of the right-hand volute section 26 emerges from the top plate 61 of the suction chamber through a suitable opening, as depicted in FIG. 1. In a similar manner, the lower portion of the volute, right-hand volute section 26 emerges from the suction chamber through the lower plate 62 of the chamber with the volute section I being welded to the flange member 71A.

In a similar manner, the left-hand section of the pump casing comprises the lower flange member 65A which is similar to the flange member 71A associated with the right-hand casing portion and the upper flange member 65 which is complementary to the upper flange member 71 associated with the upper portion of the right-hand section of the casing.

Figures 5, 6, 7:
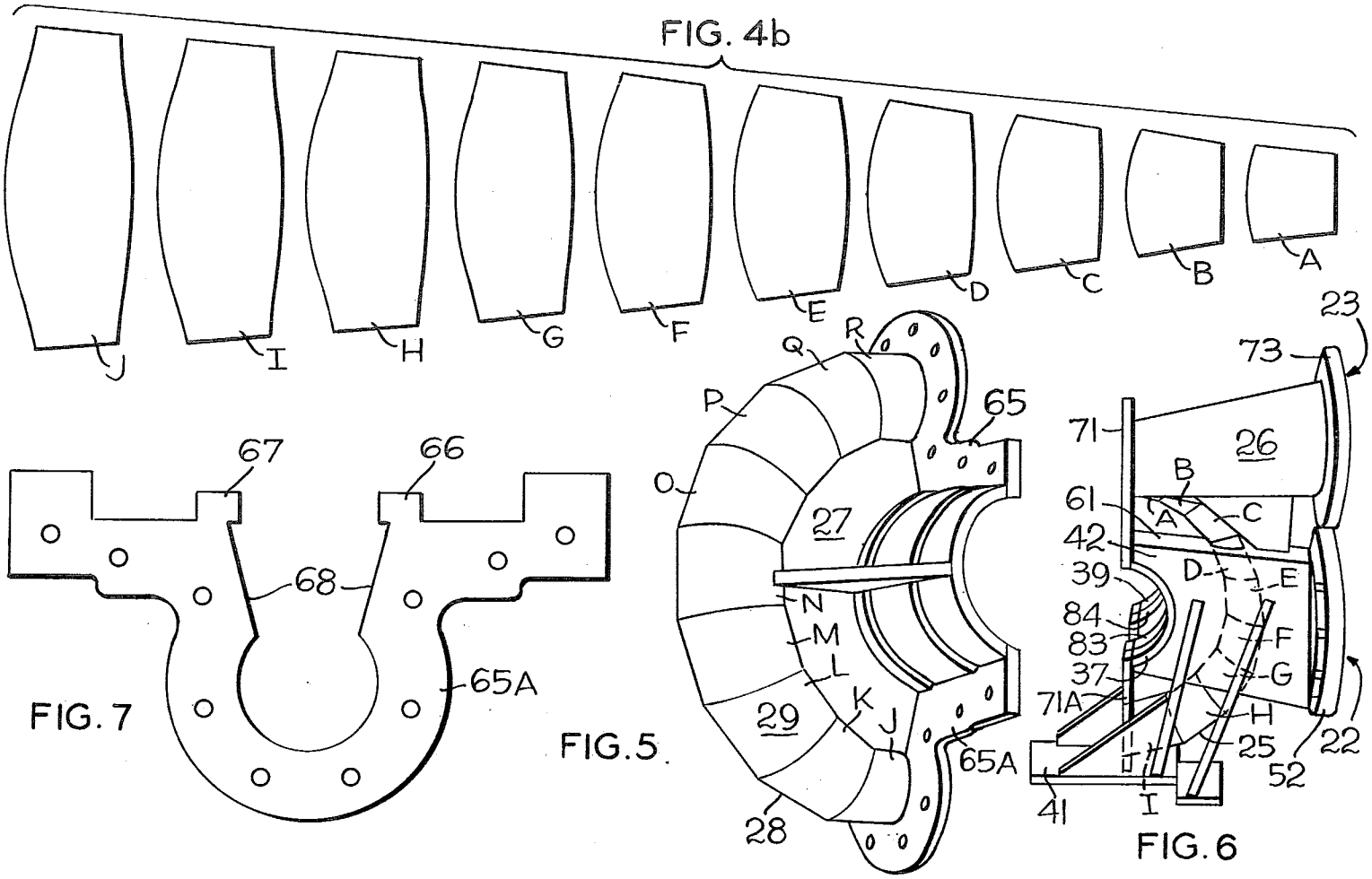
FIG. 5 is a perspective view of the left-hand section of the split casing of FIG. 1 showing the one-half of the volute section welding to one cone side and to the upper and lower flange members.
FIG. 6 is a view in side elevation of the right-hand section of the casing of FIG. 1 showing the discharge and suction on the same side and welded to upper and lower flange members for mating engagement with the left-hand section of FIG. 5.
FIG. 7 is a plan view representative of the upper and lower flange members of each closing section.

The volute section of the right-hand portion of the casing, as viewed in FIGS. 1, 3 and 6 are formed of a plurality of sectional pieces which are curved to provide a smoother progression of the flow of fluid from the pump chamber 30 through gradually increasing sections A, B, C, D, E, F, G, H and I of the volute associated with the right-hand portion 26 of the casing. The volute sections J, K, L, M, N, O, P, Q and R, associated with the left-hand portion 27 of the casing, are welded to the cone sections 33 and 34.

Associated with the right-hand section 26 of the casing there is provided a discharge cone outlet 23, the small end of which is in communication with the largest section R of the end of the volute associated with the left-hand portion of the casing. The small end of the cone 23 is welded into the circular cutout portion 72 of the flange. The cutout portion of the flange mates with and is in communication with a like cutout portion formed in the flange to which the end of the end section I of the volute is welded. The opposite or larger end of the cone terminates and is welded into an opening provided in a discharge flange member 73 which is adapted to mate with a customer's pipe.

Thus, fluid into the suction chamber flows into the pump chamber 30 where the fluid is impelled by impeller action through the progressively increasing volute 29, discharging into the discharge cone 23 and flowing out through the large end 23 of the cone. The two sections of the casing sections, as shown in FIG. 1 are bolted together to form a sealed complete pump casing.

In fabricating the volute 29, the number of sections that the volute is to have must be determined. For the particular double-suction pump, herein disclosed, the volute has been made in 18 sections A through R, each of 20° increment, as shown in FIG. 1. The 18 section volute was chosen since the casing itself must have a parting line. That is, the casing is split vertically wherein the suction 22 and discharge 23 are on the same side of the casing. In this manner, the rotating elements can still be removed without dismantling the piping. With the number of sections established, a throat area is chosen as an input to the computer program. The third area herein referred to is the area at the last cross-section of the volute R, adjacent to the discharge chamber or cone 23. With this established, the computer will know that the area in the volute should step down linearly as you go around to the small end of the volute. Therefore, the area at the cross-section #1 taken between volute section A and B should be 1/18th of the throat area. This is normal practice for a volute design. With these parameters established, the computer program will then progress around the entire volute and will find the necessary cross-sectional areas at each weld joint. The computer program will also find a "Radius" and "Center" which gives the proper area. The "R" and "C" change at each cross section as indicated in FIG. 2. As indicated in FIG. 2 "R" equals the arc radius for each volute section. "C" equals the center from which the radius "R" is struck. As indicated, several of the smallest sections have minus "C" centers which are located below the base circle line 80. However, the majority of the sections are all positive "C" centers located within the volute section arc. The base circle which is 2×OB, is the width of the base circle between the arc radius. In FIG. 3, there are two other dimensional factors, one of which is indicated as OA, which is the radius of the base circle and the dimension TM which is the material thickness from which the volute sectors are to be formed. Thus, the width of the volute, that is 2× the OB and the radius of the base circle that the volute will be built on the base circle OA must be inputed to the computer. The process used in this computer program is known as the triangulation technique. This program breaks up the surface of each volute section into a series of triangles which are then used to lay out the flat development. With the volute sections A through R formed, they are curved so that all have the same base circle width. Each sector is then welded to the associated volute half cone sections which in turn is welded to the two-piece volute ring.

Each pump section is provided with upper 65 and 71 and lower flange 65A and 71A plate members. The upper flange plate members of each section being identical and the lower flange plate members for each of the section being identical and these flange members receive the respective associated volute section as shown in FIG. 6.

With the parting line being established as shown, the rotating element [not shown] can be removed without dismantling the piping. The structure depicted in which the suction passage is on the same side as the discharge passage provides for the suction chamber to have more area since the volute sections A through I which pass through the center of the suction chamber are the smallest of the volute sections. Thus, the move of position for the suction passages gives it more area for a quieter, smoother operating pump.

The double-suction fabricated casing, as disclosed above, provides the advantages of flexibility in design, no pattern cost, less lead time and provides the ability to utilize selected type of metal, such as stainless steel. Also, with the positioning of the suction chamber the discharge on the same side of the suction chamber area is increased since only the smallest volute sections are within the suction chamber. This reduces cavitation, noise, fluid separation and vibration.

The embodiments of the invention in which an exclusive property or privilege is claimed are defined as follows:

1. A fabricated split casing for a pump;

a first casing section fabricated from sheet steel and defining a suction chamber having an entrance opening for fluid and a discharge chamber having a discharge opening for fluid;

a first casing section flange means fabricated from sheet steel to which said suction chamber and said discharge chamber are welded;

a pair of spaced apart semi-circular volute rings each welded to said first casing section flange means;

a first one-half section of a volute fabricated from sheet steel welded within the first casing section to said flange means, and within said suction chamber;

a first semi-cylindrical bearing support welded to said suction chamber and to said first casing flange means, and extending outwardly from said suction chamber;

a second casing section fabricated from sheet steel;

a second casing section flange means fabricated from sheet steel complementary to said flange means associated with said first casing section for mating engagement to provide a casing parting line;

a second semi-cylindrical bearing support welded to said suction chamber and to said second casing flange means, and extending outwardly from said suction chamber;

a pair of spaced apart semi-circular volute rings each welded to said second casing section flange means, said pairs of volute rings associated with said first and second casing section defining volute fluid entry passages when said casing sections are mated;

a second one-half section of a volute fabricated from sheet steel welded to the second casing section flange means and adapted to be in communication with said one-half volute associated with said first casing section and said discharge chamber when said first and second casing sections are mated.

2. A fabricated pump casing according to claim 1 wherein the suction chamber and the discharge chamber are fabricated as separate members welded to the flange means of said first casing section.

3. A fabricated pump casing according to claim 2 wherein the suction chamber is formed as a rectangular box structure in which the small portion of the volute passes.

4. A fabricated pump casing according to claim 3 wherein said volute is fabricated from eighteen separate sections welded together, said volute sections being divided equally between the two split sections of the casing.

5. A fabricated pump casing according to claim 4 wherein the angle between each volute section is between 15°–20° with the center being located at the center of the impeller chamber.

* * * * *